US009746819B2

(12) United States Patent
Kadowaki

(10) Patent No.: US 9,746,819 B2
(45) Date of Patent: Aug. 29, 2017

(54) POWDER COLLECTION CONTAINER AND IMAGE FORMING APPARATUS INCLUDING THE SAME

(71) Applicant: Sharp Kabushiki Kaisha, Osaka (JP)

(72) Inventor: Hideaki Kadowaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/157,769

(22) Filed: May 18, 2016

(65) Prior Publication Data

US 2016/0342131 A1 Nov. 24, 2016

(30) Foreign Application Priority Data

May 20, 2015 (JP) ..... 2015-102528
Apr. 28, 2016 (JP) ..... 2016-090401

(51) Int. Cl.
*G03G 21/12* (2006.01)

(52) U.S. Cl.
CPC ..... *G03G 21/12* (2013.01); *G03G 2215/0132* (2013.01)

(58) Field of Classification Search
CPC ..... G03G 21/12; G03G 15/0121
USPC ..... 399/360
See application file for complete search history.

(56) References Cited

U.S. PATENT DOCUMENTS 5,398,098 A * 3/1995 Fukunaga ..... G03G 15/0844 399/110
7,190,924 B2 * 3/2007 Watanabe ..... G03G 21/0064 399/257
2011/0123207 A1 * 5/2011 Sato ..... G03G 21/12 399/35
2013/0164003 A1 * 6/2013 Aoshima ..... G03G 21/12 399/35
2013/0183050 A1 * 7/2013 Kwon ..... G03G 21/12 399/35

FOREIGN PATENT DOCUMENTS

JP 2010-072310 A 4/2010
JP 2014-115379 * 6/2014

* cited by examiner

*Primary Examiner* — Sandra Brase
(74) *Attorney, Agent, or Firm* — Renner, Otto, Boisselle & Sklar, LLP

(57) ABSTRACT

A collection container is divided by a divider plate into waste developer collection chambers in communication with waste developer reception ports for each color developer and a single waste toner collection chamber in communication with waste toner reception ports for each color toner. Further, the divider plate is a part of the inner wall of the collection container and the part is installed extending in the vertical direction to define a clearance between the divider plate and the bottom plate of the collection container. This makes it possible to collect color waste toner and color waste developer with a simple configuration.

11 Claims, 7 Drawing Sheets

POWDER COLLECTION CONTAINER AND IMAGE FORMING APPARATUS INCLUDING THE SAME

CROSS REFERENCE

This Nonprovisional application claims priority under 35 U.S.C. §119(a) on Patent Application No. 2015-102528 filed in Japan on May 20, 2015, and Patent Application No. 2016-090401 filed in Japan on Apr. 28, 2016, each of the entire contents of which are hereby incorporated by reference.

BACKGROUND OF THE INVENTION

Technical Field

The present invention relates to a powder collection container that collects waste powder such as waste toner and waste developer, and also to an image forming apparatus including such a powder collection container.

Background Art

In a developing device that uses two component developer, toner is sequentially consumed by a development operation whereas carrier remains in the developing device without being consumed. Accordingly, as the carrier is more frequently stirred in the developing device, the charging performance of the developer is gradually deteriorated. The developing device, therefore, employs a trickle system, discharges developer that has become excessive while supplying the carrier in a trickle, and discards and collects such excess developer in a collection container as deteriorated developer. Successive repetition of such supply and discharge causes the deteriorated developer in the developing device to be replaced with newly supplied toner and carrier, which makes it possible to maintain the charging performance of the toner and to prevent deterioration in copy image quality. In addition, an image forming apparatus cleans residual toner on the surface of a photoreceptor, and residual toner of a secondary transfer portion, and then collects the residual toner in a collection container. The collection container for the deteriorated developer and the residual toner is installed just on the inner side of an opening/closing door on the rear side of the image forming apparatus. The deteriorated developer and the residual toner are carried out to the collection container through a discharge path.

On the one hand, such an image forming apparatus that employs the trickle system is a machine with a high speed specification and has a configuration in which the deteriorated developer and the residual toner are merged together and then are collected in a single collection container through the discharge path. On the other hand, a small image forming apparatus with a middle and low speed specification, for example, has a problem that the rear side area is not large enough to provide a space in which a path for merging developer and toner is arranged.

Japanese Patent Laid-Open publication No. 2010-72310 discloses that an image forming apparatus of a tandem type includes a collection container capable of collecting color residual toner and black deteriorated developer in separate collection chambers in a single collection container through separate discharge paths and of individually discarding the color residual toner and the black deteriorated developer through separate waste holes.

SUMMARY OF THE INVENTION

Technical Problem

The collection container disclosed in Japanese Patent Laid-Open publication No. 2010-72310, however, fails to disclose a structure in the case of discarding color developer since only black color is targeted as the deteriorated developer and other colors are not targets as deteriorated developer. In addition, the collection container includes a storage chamber that is divided vertically into two storage chambers each for residual toner and black deteriorated developer, so that the storage chamber for black deteriorated developer does not have enough height and each of divided storage chambers needs a conveying part and a stirring part in the chamber. Furthermore, the divided storage chambers each need a detecting part that detects an amount of collected residual toner and an amount of collected black deteriorated developer.

Moreover, the divided storage chambers also individually include a waste hole configured to discard residual toner and black deteriorated developer to the outside of the chamber, which makes the structure become complicated and also makes a work operation at a time of discard become complicated.

In view of the foregoing problems, some preferred embodiments of the present invention are directed to provide a powder collection container capable of collecting color discharged toner and color deteriorated developer, and also to provide an image forming apparatus including such a powder collection container.

In particular, the preferred embodiments of the present invention are directed to efficiently divide the internal space of the powder collection container into a waste developer collection chamber and a waste toner collection chamber, with a simple configuration.

In addition, some preferred embodiments of the present invention are also directed to simplify a structure for discarding waste powder and to improve operability at a time of discard.

Solution to Problem

A powder collection container according to preferred embodiments of the present invention includes: a waste developer reception port for waste developer, a waste toner reception port for waste toner, a waste developer collection chamber in communication with the waste developer reception port, a waste toner collection chamber in communication with the waste toner reception port, and a divider plate that divides the waste developer collection chamber and the waste toner collection chamber. The divider plate includes an extension that extends in the vertical direction, and the waste developer collection chamber is defined by the extension of the divider plate so as to be adjacent to the waste toner collection chamber in the short-length direction of the bottom face of the powder collection container.

Accordingly, the preferred embodiments of the present invention provide such a powder collection container that is divided by the extension installed extending in the vertical direction so as to divide the internal space of the powder collection container in the short-length direction of the bottom face of the powder collection container and thus define the waste developer collection chamber and the waste toner collection chamber that are capable of effectively using a space in the height direction of the powder collection container.

In addition, an imaging forming apparatus according to preferred embodiments of the present invention includes: the powder collection container; a housing; a color toner discharging portion that discharges color waste toner to the waste toner reception port of the waste toner collection chamber in a state in which the powder collection container is attached to the housing; and a color developer discharging portion that discharges color waste developer to the waste developer reception port of the waste developer collection chamber in the state in which the powder collection container is attached to the housing. Such a configuration is capable of providing an image forming apparatus with a simple configuration and also with easy operability of discarding waste toner and waste developer.

Advantageous Effects of Invention

Some preferred embodiments of the present invention make it possible to provide a powder collection container capable of collecting color waste toner and color waste developer with a simple configuration, and also to provide an image forming apparatus including such a powder collection container.

In particular, the preferred embodiments of the present invention are directed to efficiently divide the internal space of the powder collection container into a waste developer collection chamber and a waste toner collection chamber, with a simple configuration.

In addition, a clearance and a waste hole according to preferred embodiments of the present invention make it possible to simplify a structure for discarding powder and also to improve operability at a time of discard.

The foregoing and other features and attendant advantages of the present invention will become more apparent from the reading of the following detailed description of the preferred embodiments with reference to the attached drawings.

DETAILED DESCRIPTION OF THE PREFERRED EMBODIMENTS

Figure 1:
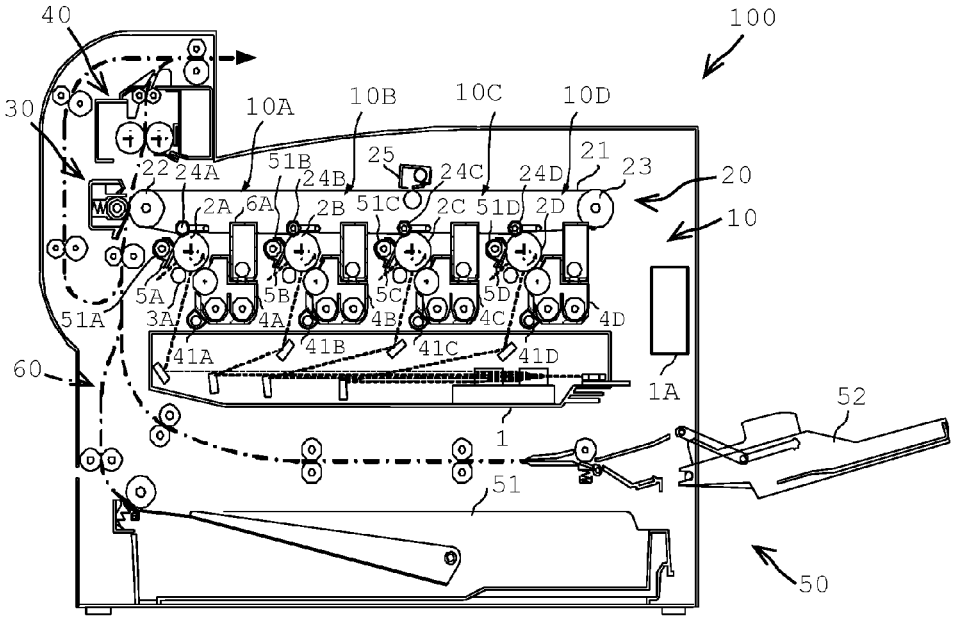
FIG. 1 is a front view schematically illustrating an entire configuration of an image forming apparatus to which a powder collection container according to a preferred embodiment of the present invention is applied.

As shown in FIG. 1, an image forming apparatus 100 includes an image forming portion 10, an intermediate transfer portion 20, a secondary transfer portion 30, a fusing portion 40, a sheet feeding portion 50, and a sheet conveyance path 60. It is to be noted that the image forming apparatus 100 may also include a reading portion that optically reads a document image, and an automatic document feeder, when necessary. The image forming apparatus 100 performs a color image forming process or a monochrome image forming process on a sheet of paper, using color image data or monochrome image data that has been input from a not-illustrated external device or image data of a document that has been read out by the reading portion.

The image forming portion 10 employs a tandem system and includes a light beam scanning unit 1 and image forming portions 10A to 10D each of which corresponds to a single color and has a similar structure. The light beam scanning unit 1 includes a semiconductor laser, converts image data of each of RGB color pixels corresponding to an input color document to concentration data of colors: black (K), cyan (C), magenta (M), and yellow (Y), exposes and scans the surfaces of photoreceptor drums 2A, 2B, 2C, 2D (2A is representatively shown while 2B to 2D are not shown) of the image forming portions 10A to 10D in an axial direction (a primary scanning direction) with laser light modulated using a duty ratio corresponding to converted concentration data of each of the colors, and then forms an electrostatic latent image of each color on the surface of each of the photoreceptor drums 2A to 2D. The image forming portion 10A described as a representative example performs development of black (K), includes the photoreceptor drum 2A as an image bearing member, and also includes a charging device 3A, a developing device 4A, and a cleaning device 5A around the photoreceptor drum 2A in the rotation direction (secondary scanning direction). A developer supplying device 6A supplies a development agent. The developing device 4A supplies toner to the photoreceptor drum 2A and makes the electrostatic latent image visible as a toner image. The cleaning device 5A cleans the photoreceptor drum 2A mainly by scraping residual toner on the photoreceptor drum 2A after the toner image has been transferred to a recording sheet. It is to be noted that, in FIG. 1, the developing device 4A is arranged below the photoreceptor drum 2A and the intermediate transfer portion 20 to be described later is arranged above the photoreceptor drum 2A.

The developing device 4A, although not described in detail because being publicly known in the trickle system, discharges developer of a predetermined amount set by the number of printing sheets as deteriorated developer (waste developer) from the inside of the developing device 4A by a not-illustrated discharging roller and the like to a discharging portion 41A arranged below the developing device 4A. The discharging portion 41A has a not-illustrated tubular discharge path and a not-illustrated internal screw that are installed in the depth direction (on the rear side of the image forming apparatus 100), the internal screw conveying the discharged waste developer to the downstream side. On the rear side of the image forming apparatus 100, a collection container 9 (see FIG. 2 and the other drawings, and the details are described later) that collects the carried-out waste developer is removably installed. The collection container 9 is capable of being removed by opening a not-shown opening/closing door in the rear face, in the short-length direction of the bottom face of the powder collection container and making a discard operation possible to discard collected waste developer.

In addition, the cleaning device 5A has a discharging portion 51A such as a screw having a rotating shaft in the depth direction of FIG. 1. The discharging portion 51A conveys the cleaned residual toner to the collection container 9 on the rear side and causes the collection container 9 to collect the residual toner as waste toner. It is to be noted that, as described later, the capacity of the collection chamber for waste toner of the collection chamber 9 is designed to be associated with the number of printing sheets. The amount of the residual toner is determined under the assumption that a sheet of paper has a standard size and a print coverage is a predetermined percentage, and the amount of the collected residual toner per printing sheet is set up. As an example of standard size printing, the capacity of the collection chamber is set to be full of the expected amount of residual toner when 100,000 standard A4 sheets are printed at a print coverage of 5%. It is to be noted that the discharging portions 41A, 41B, 41C, and 41D and the discharging portions 51A, 51B, 51C, and 51D are provided for each color.

The intermediate transfer portion 20 is arranged above the image forming portion 10, includes an intermediate transfer belt 21, a driving roller 22, a driven roller 23, and primary transfer rollers 24A, 24B, 24C, and 24D, and primarily transfers the toner images (developer images) formed on the circumferential surfaces of the photoreceptor drums 2A to 2D onto the surface of the intermediate transfer belt 21 as an image bearing member. The secondary transfer portion 30 secondarily transfers the toner image on the surface of the intermediate transfer belt 21 onto a sheet of paper. The intermediate transfer portion 20 further includes a discharging portion 25. The discharging portion 25 is arranged in an appropriate position of a circulation path of the intermediate transfer belt 21 so as to face the intermediate transfer belt 21, collects the residual toner that remains on the intermediate transfer belt 21 after the toner image is fused and fixed, and includes a publicly known cleaning member in contact with the intermediate transfer belt 21, a cover member covering the cleaning member installed extending in the depth direction of FIG. 1, and a screw having inside a rotating shaft. The discharging portion 25 discharges the residual toner in the intermediate transfer portion 20 to the collection container 9 in the depth direction of the surface of the drawing sheet.

The fusing portion 40 heats and fuses the toner image transferred onto the sheet of paper and then outputs the sheet of paper to a sheet output tray. The sheet feeding portion 50 includes a sheet feed cassette 51 or a manual sheet feed tray 52 and feeds a selected sheet of paper to the sheet conveyance path 60.

Subsequently, the collection container 9 is described with reference to FIG. 2 to FIG. 7. In the present preferred embodiment, the collection container 9 has a nearly rectangular parallelepiped shape and has a predetermined thickness in order to secure a space for a collection chamber or the like. The collection container 9, as the dimension in the horizontal direction in FIG. 2, has at least a dimension including the dimension of the horizontal direction of the image forming portions 10A to 10D and the dimension of the discharging portion 25, as shown in FIG. 1. In addition, the collection container 9, as the dimension in the height direction, has a dimension in the height direction from the positions of the discharging portions 41A to 41D of the developing devices 4A, 4B, 4C, and 4D of the image forming apparatus 10 in FIG. 1 to the positions of the discharging portions 51A to 51D of the cleaning devices 5A, 5B, 5C, and 5D arranged above the discharging portions 41A to 41D, and further to the position of the discharging portion 25 as necessary.

Figure 3:
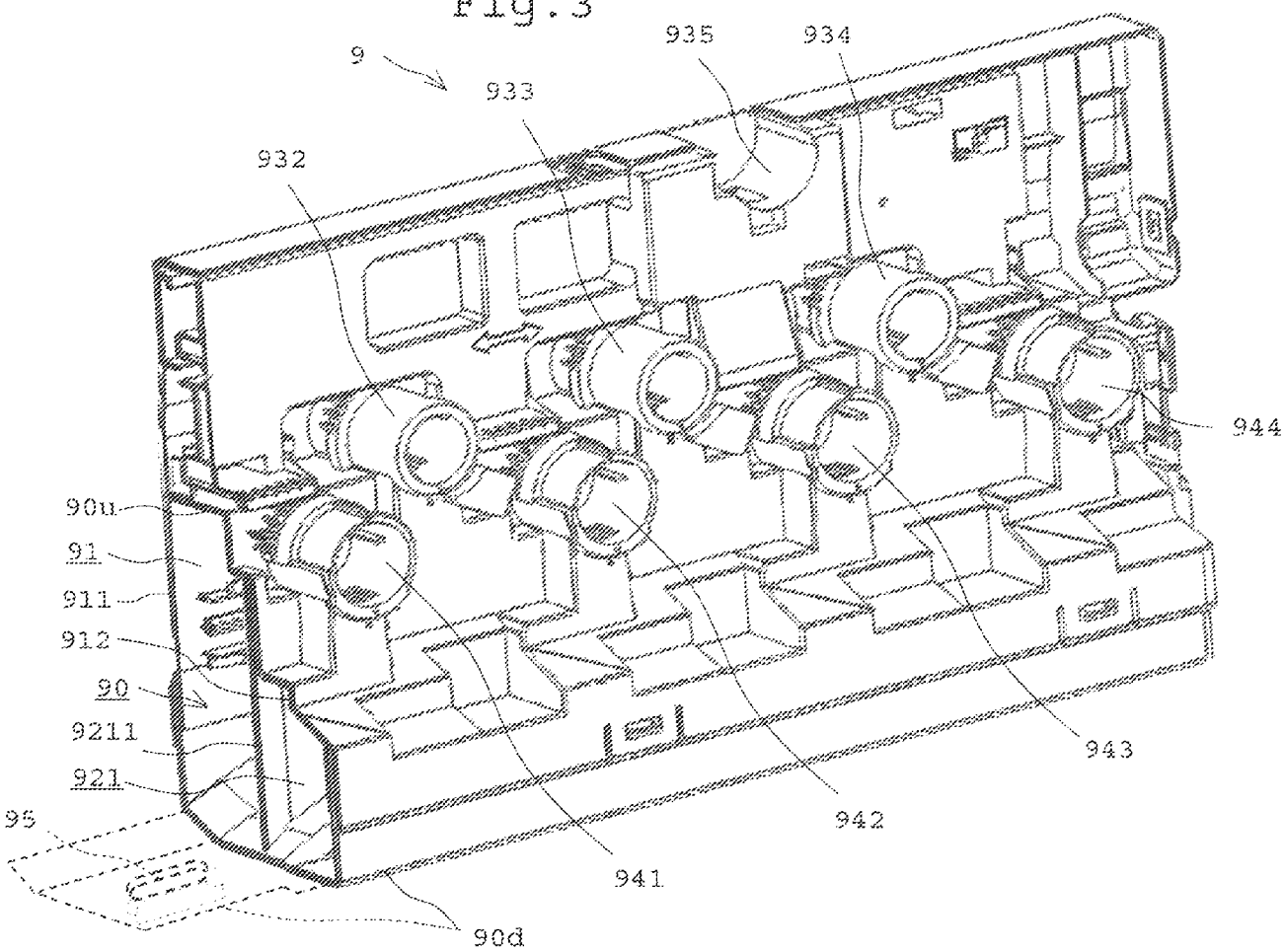
FIG. 3 is a top perspective front view of the powder collection container that is vertically cross-sectioned along a line in FIG. 2.
Figure 5A:
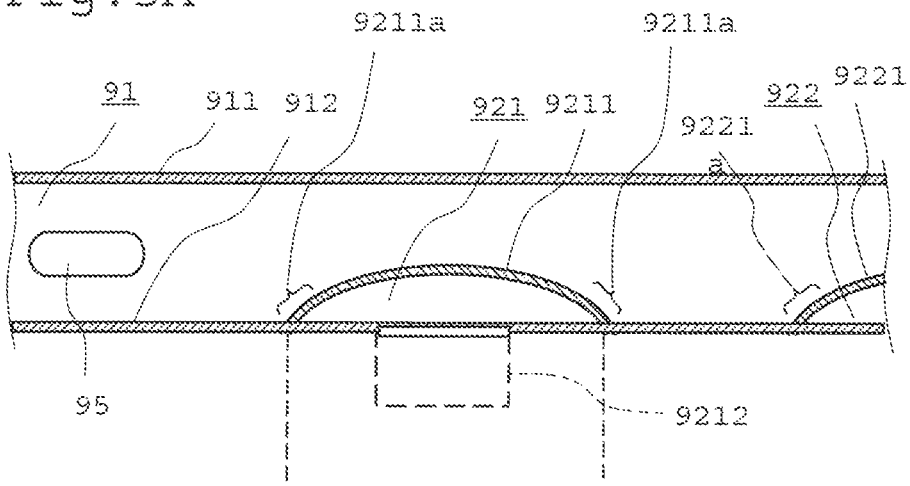
FIG. 5A is a partial plan view schematically illustrating a divider plate between a waste toner collection chamber and a waste developer collection chamber and components around the divider plate.
Figure 6:
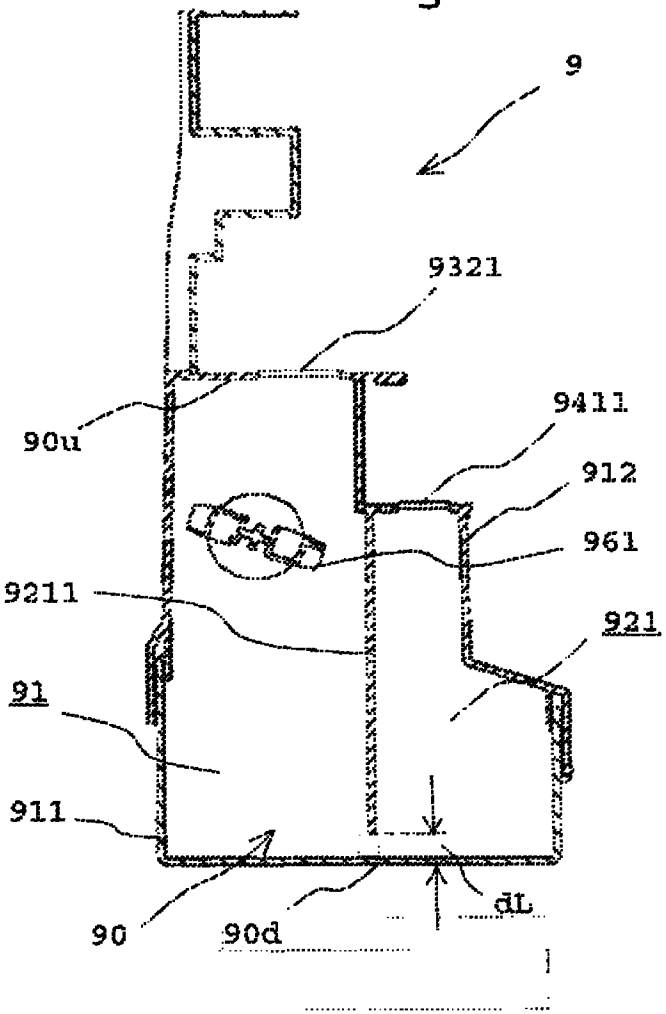
FIG. 6 is a view of the powder collection container that is vertically cross-sectioned along a line V-V in FIG. 2.

As mainly shown in FIG. 3 and FIG. 6, the collection container 9 includes a bottom plate 90*d* on the lower side and a top plate 90*u* on the upper side, and further includes a rear plate 911 on the rear side and a front plate 912 on the front side, and an internal space 90 surrounded by all the above stated plates, a right side plate, and a left side plate, the internal space 90 being divided by divider plates 9211, 9221, 9231, and 9241 that are installed extending vertically and will be described later into a waste toner collection chamber 91 and waste developer collection chambers 921, 922, 923, 924 that are divided in the front and rear direction (short-length direction). In addition, the collection container 9 includes, on the front side (front face), a waste toner reception port 93 and a waste developer reception port 94 in communication with the internal space 90, and a waste hole 95 (see FIG. 3 and FIG. 5A) provided in an appropriate position of the bottom plate 90*d*.

The waste toner collection chamber 91 is, as shown in FIG. 3 and FIG. 5A, defined by using the space between the rear plate 911 and the front plate 912 that are parallel to each other and are installed in the horizontal direction (long-length direction) parallel to the arrangement direction of the image forming portions 10A to 10D. In the present preferred embodiment, the lower half portion of the front plate 912 projects to the front side of the collection container 9, which thus causes the collection container 9 to secure a greater capacity.

Figure 2:
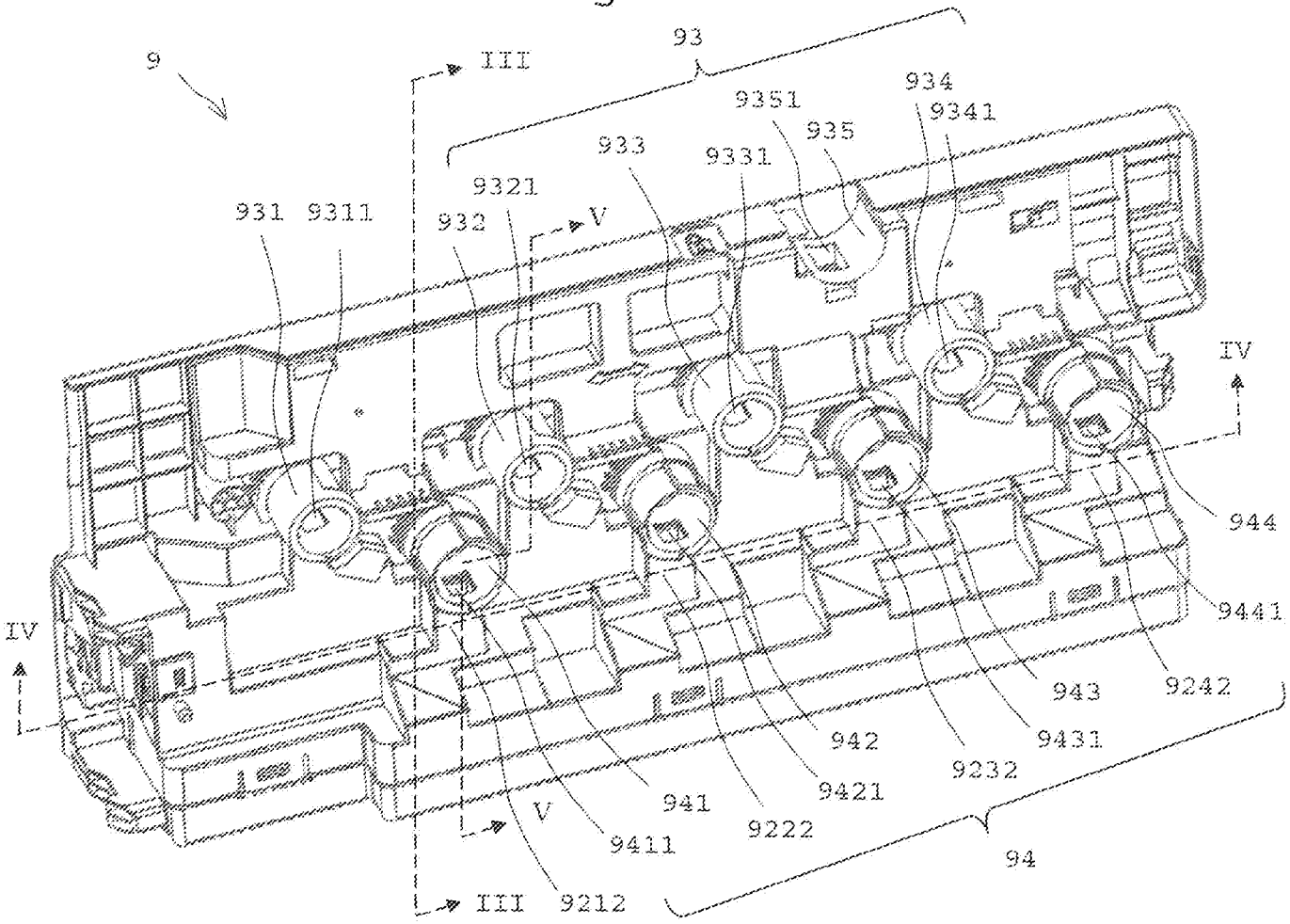
FIG. 2 is a top perspective front view of a powder collection container according to a first preferred embodiment of the present invention.

The waste toner reception port 93, as shown in FIG. 2 and FIG. 3, has reception ports 931, 932, 933, and 934 for each color and a waste toner reception port 935 above the top plate 90*u*. The reception ports 931 to 935 are arranged in positions on the rear side so as to correspond to the discharging portions 51A to 51D for each color and the discharging portion 25 as shown in FIG. 1 and are in communication with each other. The reception port 931 corresponds to K-color (monochrome) toner, the reception port 932 corresponds to C-color toner, the reception port 933 corresponds to M-color toner, the reception port 934 corresponds to Y-color toner, and the reception port 935 corresponds to discharged toner that is discharged from the discharging portion 25. The reception ports 931 to 935 each have a predetermined length and a bottomed tubular shape on the deeper side and include drop holes 9311, 9321, 9331, 9341, and 9351 provided at the lower portion of the circumferential surface (see FIG. 2 and FIG. 6). The drop holes 9311 to 9351 are in communication with the collection chamber 91. Accordingly, the waste toner that has dropped from the drop holes 9311 to 9351 drops down to the collection chamber 91 and is collected in the collection chamber 91.

Subsequently, a description is directed to a structure of storing waste developer, and, to begin with, to a waste developer reception port 94. The reception port 94 includes reception ports 941, 942, 943, and 944 for each color. The reception ports 941 to 944 are arranged in positions on the rear side so as to correspond to the discharging portions 41A to 41D for each color as shown in FIG. 1 and are in communication with each other. The reception port 941 corresponds to K-color (monochrome) developer, the reception port 942 corresponds to C-color developer, the reception port 943 corresponds to M-color developer, and the reception port 944 corresponds to Y-color developer. The reception ports 941 to 944 provided corresponding to the discharging portions 41A to 41D are set to be positioned lower than the reception ports 931 to 935 provided corresponding to the discharging portions 51A to 51D and the discharging portion 25. The reception ports 941 to 944 each have a predetermined length and a bottomed tubular shape on the deeper side and include drop holes 9411, 9421, 9431, and 9441 provided at the lower portion of the circumferential surface. The drop holes 9411 to 9441 are, at the lower side, in communication with reception areas 9212, 9222, 9232, and 9242 (see FIG. 2) defined in a convex shape on the front side. The drop holes 9411 to 9441 are in communication with waste developer collection chambers 921, 922, 923, and 924 (see FIG. 6) through the inside of the reception areas 9212 to 9242 that also function as storage portions.

Figure 4:
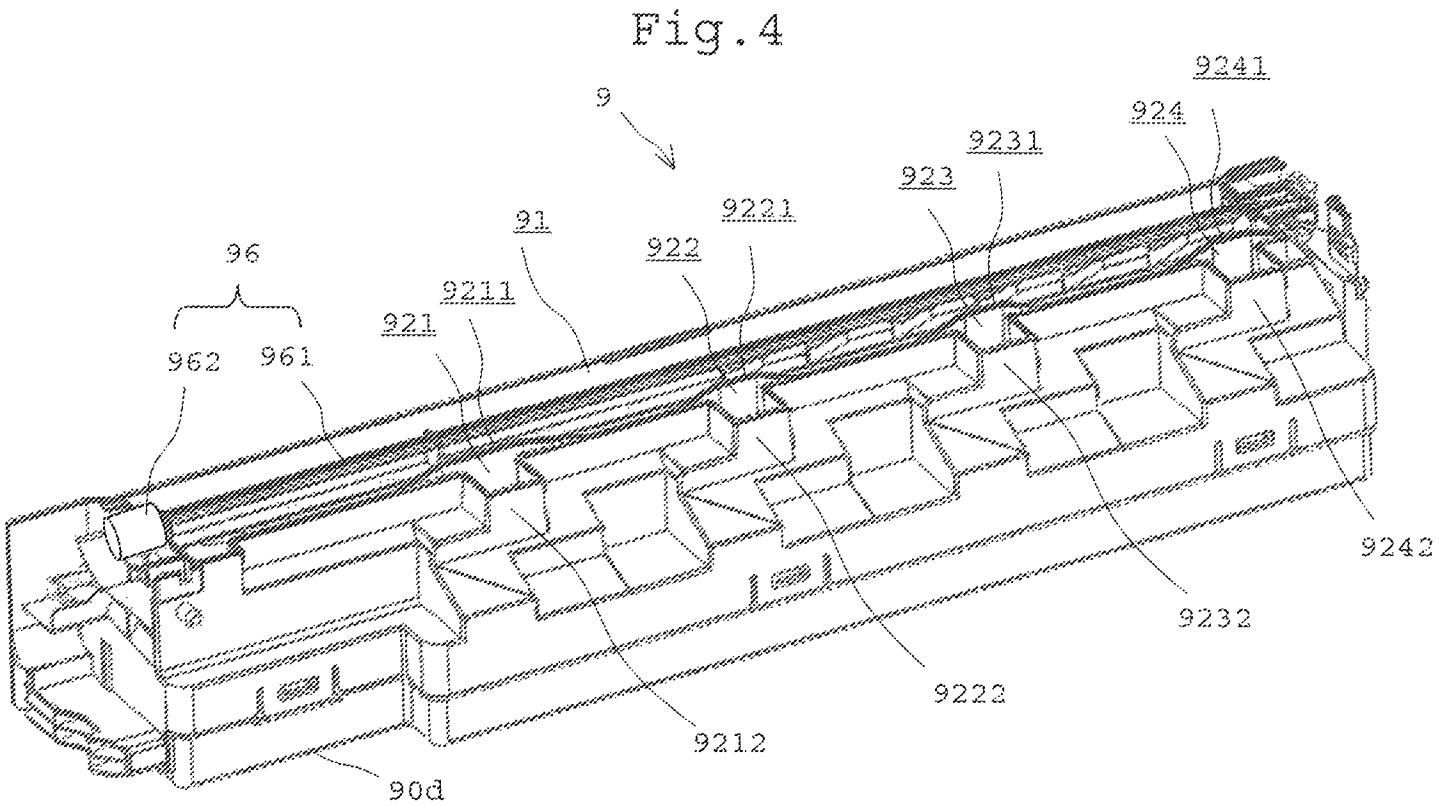
FIG. 4 is a top perspective front view of the powder collection container that is laterally cross-sectioned along a line IV-IV in FIG. 2.
Figure 7:
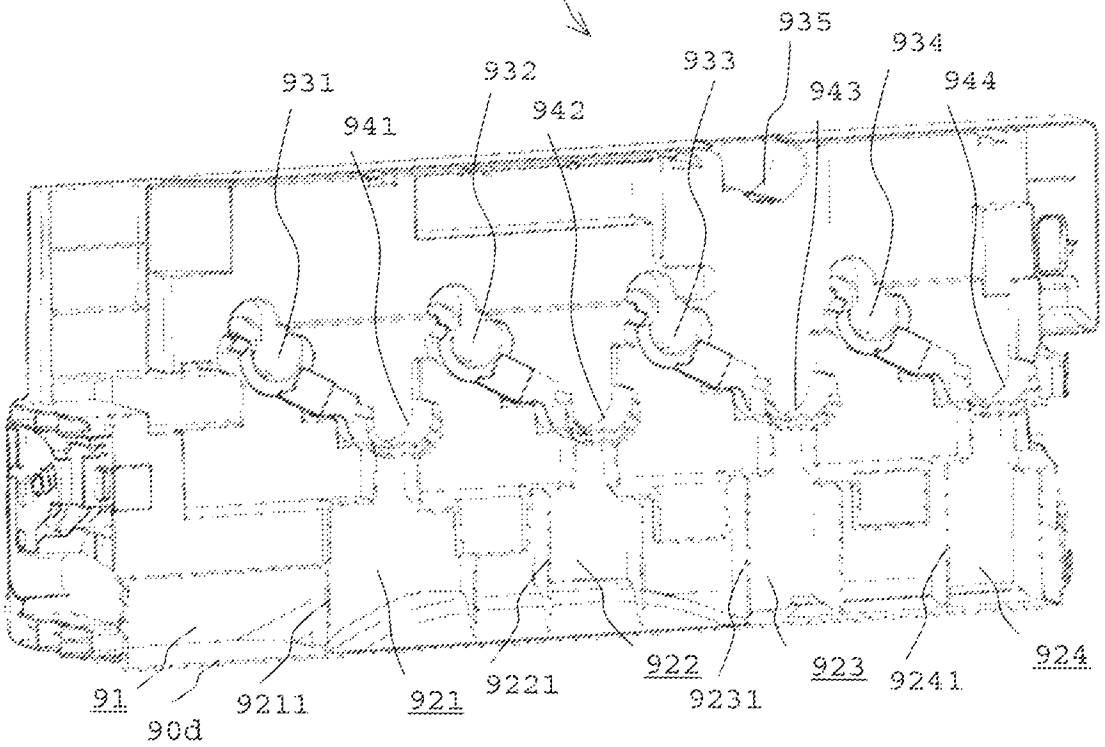
FIG. 7 is a vertical cross-sectional perspective view of the powder collection container viewed from an oblique upper part of a front side, a front plate of the powder collection container being omitted so that the shape of the divider plate in color waste developer collection chamber can be seen.

Subsequently, a description is directed to a divider plate that defines each of the waste developer collection chambers 921 to 924. The waste developer collection chambers 921 to 924 are, in the present preferred embodiment, defined by dividing a part of the area of the collection chamber 91. The collection chambers 921 to 924 are defined in four positions away from each other in the horizontal direction of the collection chamber 91, that is, corresponding to each of the colors. The collection chambers 921 to 924, as shown in FIG. 4, FIG. 5A, and FIG. 7, have a similar shape.

The collection chambers 921 to 924 are defined by each of the divider plates 9211 to 9241 installed extending from each of the reception ports 941 to 944 toward the bottom face 90*d* of the lower side (see FIG. 3, FIG. 4, FIG. 6, and FIG. 7). The divider plates 9211 to 9241 each have an arc shape or a convex shape that forms into a trapezoidal shape in a plan view and also contact the inner face of the front plate 912 of the collection chamber 91 at both right and left ends. The collection chambers 921 to 924 are defined between the divider plates 9211 to 9241 and the front plate 912. In this manner, the divider plates 9211 to 9241 separately define the waste toner collection chamber 91 in communication with the reception ports 931 to 934 for each color and the waste developer collection chambers 921 to 924 in communication with the waste developer reception ports 941 to 944 for each color.

The collection chamber 921 for K-color developer is defined between the front plate 912 and the divider plate 9211 installed extending from the reception port 941 toward the bottom face 90*d* of the lower side. The collection chamber 922 for C-color developer is defined between the front plate 912 and the divider plate 9221 installed extending from the reception port 942 toward the bottom face 90*d* of the lower side. The collection chambers 923 and 924 are also defined to have the same shape as the collection chamber 922 by the divider plates 9231 to 9241. In addition, the collection chamber 921 for K-color developer is used not only for color mode printing but also for monochrome (K-color) mode printing, and thus has a relatively large capacity, compared to the other collection chambers 922 to 924, for such separate printing modes. The collection chamber 921 is configured to have a capacity so as to be capable of storing at least discharge amount of waste developer or to preferably become full of waste developer at a time when the number of printed sheets of paper reaches a scheduled number of printed sheets of paper when the above-stated standard size printing is performed. In addition, the other collection chambers 922 to 924 are, as stated above, configured to each have a capacity so as to store at least discharge amount of waste developer in each of the CMY colors or to preferably become full of the color waste developer. The collection chambers 921 to 924 collect the waste developer discharged from corresponding reception ports 941 to 944. It is to be noted that the waste toner collection chamber 91 is set to have a capacity greater than the collection chambers 921 to 924, as shown in FIG. 4 and FIG. 6, since the amount of waste toner is more than the amount of deteriorated developer.

Figure 5B:
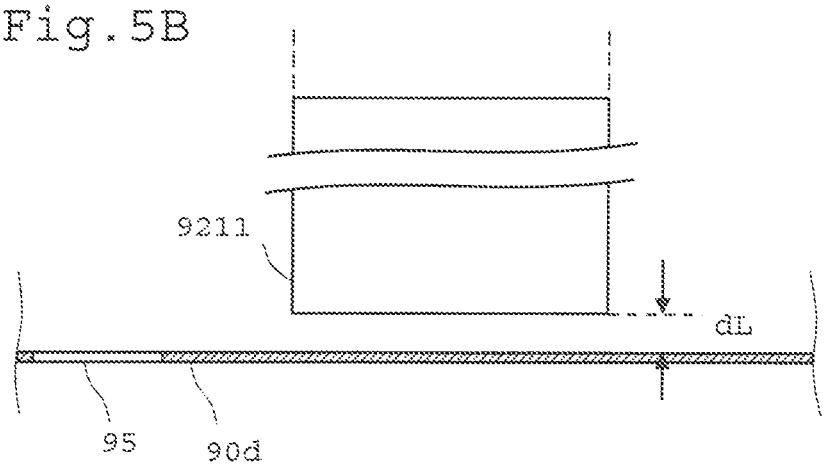
FIG. 5B is a partial front view schematically illustrating the divider plate between the waste toner collection chamber and the waste developer collection chamber and the components around the divider plate.

The divider plate 9211 is configured to be a partial inner wall of the collection chamber 91 in the present preferred embodiment. The right and left portions of the divider plate 9211 each include a taper 9211*a* indicated by a curved line or a slant line in a plan view (see FIG. 5B), which causes a stirring portion 96 (see FIG. 4) to be described later to smoothly move the waste toner stored in the collection chamber 91 in the horizontal direction and then level out the waste toner. The divider plate 9221 has a taper 9221*a*, and the other divider plates each also have a similar structure. In addition, the divider plate 9211, as shown in FIG. 3 and FIG. 5B, is not installed extending down to the bottom plate 90*d* and has a clearance dL between the bottom plate 90*d* and the divider plate 9211. Accordingly, the waste developer collected in the collection chambers 921 to 924 may drop from the lower side to the collection chamber 91. The dimension of the clearance dL may be about several mm (preferably equal to or shorter than 10 mm), depending on the height or the capacity of the collection chamber 921 or on various amounts such as the particle diameter of the developer, and may preferably be about three mm, considering the restriction of the flow of waste toner from the collection chamber 91. It is to be noted that the other divider plates each also have a similar structure.

In addition, as shown in FIG. 3, FIG. 5A, and FIG. 5B, the waste hole 95 is provided in an appropriate position of the bottom plate 90*d* in the collection chamber 91. The waste hole 95 is provided on one end side in the horizontal direction of the collection container 9, that is, on the left side in a plan view in the present preferred embodiment. The waste toner and the waste developer collected in the collection chamber 91 and the collection chambers 921 to 924 are capable of being collectively discarded from the waste hole 95. The waste hole 95 is closed by a closing member (not shown) such as a removable cap.

As shown in FIG. 4, the collection container 9 includes the stirring portion 96 for leveling out the waste toner in the collection chamber 91. The stirring portion 96 is installed extending over the right and left sides of the collection chamber 91 at a predetermined height position of the collection chamber 91 and includes a stirring shaft 961 (see FIG. 4 and FIG. 6) around which a stirring member is pivotally supported and a driving source 962 such as a motor that rotates the stirring shaft 961. The stirring portion 96 stirs and levels out the waste toner that has dropped down to the collection chamber 91 that is long in the horizontal direction, which makes it possible to further uniform the height in the horizontal direction and to prevent the waste toner from gathering non-uniformly and partially. It is to be noted that the driving source 962 may be arranged on the side of the image forming apparatus 100 so as to be connected to the stirring shaft 961 when the collection container 9 is attached to the image forming apparatus 100.

In addition, the magnitude of rotational torque of the driving source 962 may correspond to the amount of stored waste toner. Therefore, a second preferred embodiment may include a control portion 1A (see FIG. 1) including a measuring portion that measures rotational torque and the level of drive current, for example, and an estimating portion that estimates an amount of waste toner that has been collected in the collection chamber 91. Moreover, the image forming apparatus 100 may include an informing portion that issues a notification just before the estimated amount of discharged toner reaches a predetermined amount, that is, the full amount, for example. Furthermore, the amount of stored waste developer can be converted and estimated from the amount of stored waste toner, which can eliminate a measuring portion for measuring an amount of stored waste developer.

Moreover, while the clearance dL is provided between the lower end of the divider plate 9211 and the bottom plate 90*d*, as a third preferred embodiment, the divider plate 9211 may be installed extending down to the bottom plate 90*d* and a slit-like clearance may be provided in the lower portion of the divider plate 9211. The slit-like clearance may be provided along the lower end of the divider plate 9211. This stabilizes the installation position of the lower portion of the divider plate. While the divider plate 9211 is described as an exemplary case, the other divider plates also have a similar structure.

Finally, the foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A powder collection container comprising:

a waste developer reception port for waste developer;

a waste toner reception port for waste toner;

a waste developer collection chamber in communication with the waste developer reception port;

a waste toner collection chamber in communication with the waste toner reception port; and a divider plate that divides the waste developer collection chamber and the waste toner collection chamber, wherein:

the divider plate includes an extension that extends in a vertical direction;

the waste developer collection chamber is defined by the extension of the divider plate so as to be adjacent to the waste toner collection chamber in a short-length direction of a bottom face of the powder collection container; and the extension of the divider plate has a clearance between a bottom portion of either the waste developer collection chamber or the waste toner collection chamber and the extension of the divider plate.

2. The powder collection container according to claim 1, wherein the waste toner reception port is positioned higher than the waste developer reception port.

3. The powder collection container according to claim 1, comprising:

a plurality of waste developer collection chambers that are independently defined; and a single waste toner collection chamber, wherein the plurality of waste developer collection chambers each include the waste developer reception port in communication with each of the plurality of waste developer collection chambers; and the waste toner collection chamber includes a plurality of waste toner reception ports in communication with the waste toner reception port.

4. The powder collection container according to claim 3, wherein the waste toner collection chamber includes inside, a leveling member that levels out the waste toner.

5. The powder collection container according to claim 4, wherein the waste toner collection chamber includes inside, a measuring portion that measures an amount of the waste toner collected in the waste toner collection chamber.

6. The powder collection container according to claim 3, wherein:

the waste toner collection chamber becomes full of the waste toner at printing of a scheduled number of sheets of paper;

the waste developer is sequentially wasted by an amount in proportion to a number of printed sheets of paper; and the waste developer collection chamber has a capacity such that the waste developer collection chamber becomes full of the waste developer at a time when the number of printed sheets of paper reaches the scheduled number of sheets of paper.

7. The powder collection container according to claim 1, wherein the clearance between the extension of the divider plate and the bottom portion has a dimension equal to or shorter than several millimeters.

8. The powder collection container according to claim 7, wherein the dimension of the clearance between the extension of the divider plate and the bottom portion is three millimeters.

9. The powder collection container according to claim 1, further comprising:

a bottom plate; and a waste hole in the bottom plate, the waste hole being in communication with an outside of the powder collection container.

10. An imaging forming apparatus comprising:

the powder collection container according to claim 1;

a housing;

a color toner discharging portion that discharges color waste toner to the waste toner reception port of the waste toner collection chamber in a state in which the powder collection container is attached to the housing; and a color developer discharging portion that discharges color waste developer to the waste developer reception port of the waste developer collection chamber in the state in which the powder collection container is attached to the housing.

11. The imaging forming apparatus according to claim 10, wherein the powder collection container is removable from a lateral side of the housing.

* * * * *